US009126306B2

(12) United States Patent
Jarchau et al.

(10) Patent No.: US 9,126,306 B2
(45) Date of Patent: Sep. 8, 2015

(54) METHOD FOR INTERRUPTING THE FUNCTION OF A CUTTING JET AND DEVICE FOR CARRYING OUT THE METHOD

(75) Inventors: Michael Jarchau, Oelde (DE); Paulus Antonius Jacobus Janitschek, Meerhout (DE)

(73) Assignee: INFLOTEK, B.V., Oegstgeest (NL)

( * ) Notice: Subject to any disclaimer, the term of this patent is extended or adjusted under 35 U.S.C. 154(b) by 474 days.

(21) Appl. No.: 13/579,676

(22) PCT Filed: Feb. 3, 2011

(86) PCT No.: PCT/EP2011/051579

§ 371 (c)(1), (2), (4) Date: Aug. 17, 2012

(87) PCT Pub. No.: WO2011/101262

PCT Pub. Date: Aug. 25, 2011

(65) Prior Publication Data

US 2012/0315824 A1 Dec. 13, 2012

(30) Foreign Application Priority Data

Feb. 19, 2010 (DE) ..... 10 2010 000 478

(51) Int. Cl.

| | |
|---|---|
| ***B24C 7/00*** | (2006.01) |
| ***B05B 1/08*** | (2006.01) |
| ***B24C 1/04*** | (2006.01) |

(52) U.S. Cl.

CPC ..... *B24C 7/0015* (2013.01); *B05B 1/08* (2013.01); *B24C 1/045* (2013.01); *B24C 7/0007* (2013.01); *B24C 7/0046* (2013.01)

(58) Field of Classification Search

CPC .. B24C 7/0015; B24C 7/0007; B24C 7/0046; B05B 1/08

USPC ..... 451/2, 101, 102, 36, 38, 99; 137/338

See application file for complete search history.

(56) References Cited

U.S. PATENT DOCUMENTS

| | | | | |
|---|---|---|---|---|
| 4,534,139 | A * | 8/1985 | Desjardins | 451/101 |
| 4,768,709 | A * | 9/1988 | Yie | 239/8 |
| 4,945,688 | A * | 8/1990 | Yie | 451/102 |
| 4,951,429 | A | 8/1990 | Hashish et al. | |
| 5,605,496 | A * | 2/1997 | Pickard | 451/90 |
| 5,913,180 | A * | 6/1999 | Ryan | 702/45 |
| 5,927,320 | A * | 7/1999 | Pfarr et al. | 137/338 |
| 6,276,993 | B1 * | 8/2001 | Miller | 451/40 |
| 6,571,151 | B1 * | 5/2003 | Leatherman | 700/282 |
| 6,752,373 | B1 * | 6/2004 | Rudy et al. | 251/129.09 |
| 2003/0037817 | A1 * | 2/2003 | Rudy et al. | 137/338 |
| 2004/0221900 | A1 * | 11/2004 | Kaske | 137/624.13 |
| 2008/0048048 | A1 * | 2/2008 | Noestheden | 239/101 |
| 2011/0168216 | A1 * | 7/2011 | Kaske | 134/198 |

OTHER PUBLICATIONS

International Search Report, dated Mar. 29, 2011, issued in priority International Application No. PCT/EP2011/051579 (and its English translation).

* cited by examiner

*Primary Examiner* — Lee D Wilson
*Assistant Examiner* — Tyrone V Hall, Jr.
(74) *Attorney, Agent, or Firm* — Saul Ewing, LLP

(57) ABSTRACT

A method to interrupt the operation of a cutting jet exiting a cutting head having a nozzle is designed such that the cutting jet is laterally supplied with interfering means as needed following the nozzle exit which reduces the energy density of the cutting jet.

11 Claims, 3 Drawing Sheets

METHOD FOR INTERRUPTING THE FUNCTION OF A CUTTING JET AND DEVICE FOR CARRYING OUT THE METHOD

CROSS REFERENCE TO RELATED APPLICATIONS

This application claims the priority of PCT/EP2011/051579, filed on Feb. 3, 2011, which claims priority to German Application No. 10 2010 000478.2, filed Feb. 19, 2010, the entire contents of which are hereby incorporated in total by reference.

BACKGROUND OF THE INVENTION

The invention relates to a method for interrupting the operation of a cutting jet according to the preamble of claim 1 and a device to implement the method.

The cutting of materials of various types using a cutting jet has been known for a long time.

The cutting jet is formed by a fluid that is guided under high pressure, such as 3,000 to 4,000 bar, through a nozzle to which an abrasive can be added.

To interrupt the cutting jet, for example to insert a pattern of holes or slots in a metal plate, switching valves have been previously used, by means of which the supply of the pressurized fluid is interrupted before the cutting head or before entering the nozzle.

This is of course substantially problematic, especially when there is frequent switching as is required when producing delicate patterns.

The valve is subject to extreme stress from the arising high pressure which reduces its life.

The resulting cost from the downtime to change the valve and procure it prevents optimized operation.

If, for generating pressure, a plunger pump is used that generates a consistent pressure as a function of the system and can only be operated with an installed overflow system, extremely high stress also results which prevents satisfactory operation; consequently overall, the known method does not satisfy the posed requirements of minimized production and/or operating costs.

SUMMARY OF THE INVENTION

The invention is based on the problem of further developing a method of the generic type to enable the cutting jet to operate economically with a simple design, and a device to implement the method.

This problem is solved with a method having the features of claim 1 and a device having features of claim 7.

The novel method is chiefly distinguished in that the use of switching valves to interrupt the operation of the cutting jet in the area where the high-pressure fluid is supplied can be completely discarded.

That is, the high pressure is permanently in the supply line which allows a plunger pump to be easily used to generate pressure without additional, expensive equipment.

As was surprisingly shown, introducing the interrupting means sufficiently reduces the directed speed at which the cutting jet exits the cutting head, or the acceleration of a possibly introduced abrasive, so as to prevent cutting, and continuing the relative guidance of the cutting head into the uncontacted area of the material to be processed does not produce any identifiable abrasion.

By interrupting the interfering jet, i.e., interfering in the function of the cutting jet, the cutting energy is directly released, which causes a sharp cutting edge to arise when the cutting head executes a continuous relative movement in the direction of cutting.

The interfering means can consist of a liquid or gaseous medium such as water or air, or also a solid body such as an interfering pin that is guided into the cutting jet.

The introduction of the interfering means is computer-controlled, for example to generate the aforementioned pattern, whereby a gas or liquid source as the source of interference is arranged downstream from a shutoff valve in the form of a quick closing valve.

The jet exiting the nozzle in a familiar matter can be supplied an abrasive in the form of a flowable substance such as sand, etc., or the form of a suspension such as a mixture of sand and water.

When interrupting the cutting jet, the supply of the abrasive can be preferably shut off by a valve when the interfering means is introduced, and both switching procedures can be synchronously actuated in dependence on each other.

A device for implementing the method according to claim 1 in which the cutting head has an exit channel downstream from the nozzle in the direction of flow is designed such that an interfering means supply opens into the side of the exit channel into which an interfering means switchable in a computer-controlled manner by an actuating organ is cyclically guided.

The interfering means supply can form a guide for an interfering pin, or if the interfering means consists of a liquid or gas, a guide channel.

In WO 91/12930 A1, a device for cutting materials with a cutting head is known with a fluid channel that opens into its exit channel; however, this device is exclusively for use when there is a high ambient pressure, and the constant lateral supply of fluid during operation is to prevent abrasion to the exit channel, and the geometry of the cutting jet is also influenced. This construction is incapable of interrupting the operation of the cutting jet.

This equally applies to a device that is disclosed in WO 2000/056466. The fluid jet supplied in the side of the exit channel is exclusively for changing the coherence of the cutting jet so that materials of different natures, especially with different hardnesses, can be satisfactorily cut.

In a preferred embodiment of the device according to the invention, the valve for turning on and off the supply of interfering means is in the cutting head, which yields a very compact and economical design of the overall device.

A supply line for an abrasive—if used—that also is led into the side of the exit channel empties preferably directly opposite the supply of interfering means or slightly offset therefrom, preferably downstream from the supply of interfering means.

Additional advantageous embodiments of the invention are characterized in the subclaims.

BRIEF DESCRIPTION OF THE DRAWINGS

The method according to the invention will be described again with reference to the attached exemplary embodiments of a device for implementing the method shown in the drawings.

They show.

DETAILED DESCRIPTION OF THE INVENTION

Figure 1:
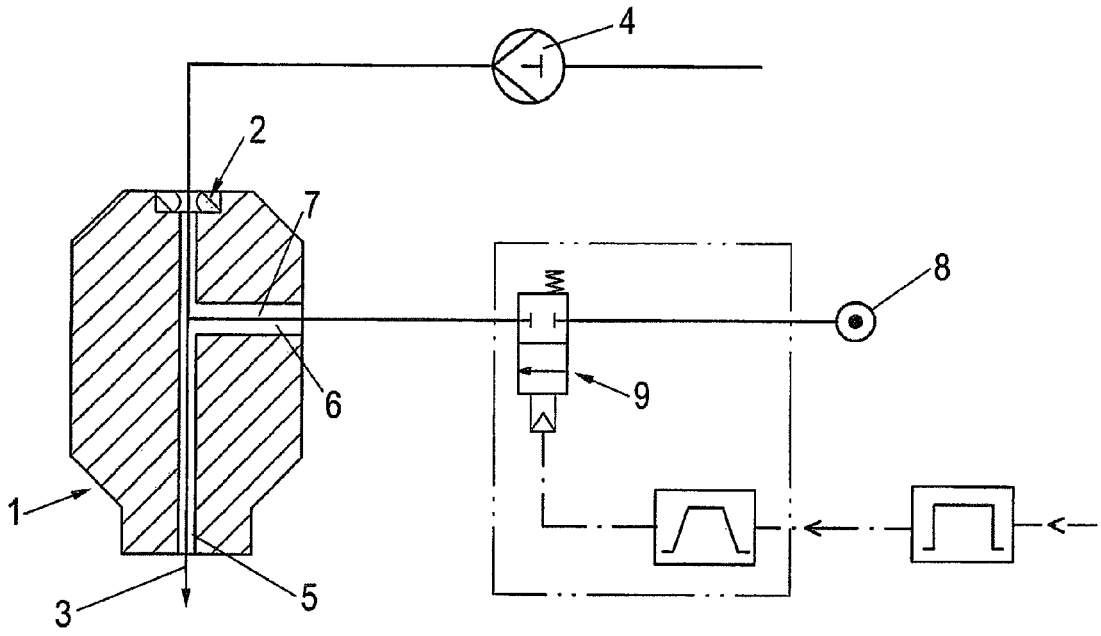
FIG. 1-3 A schematic representation of an exemplary embodiment in each case of a device according to the invention.
Figure 2:
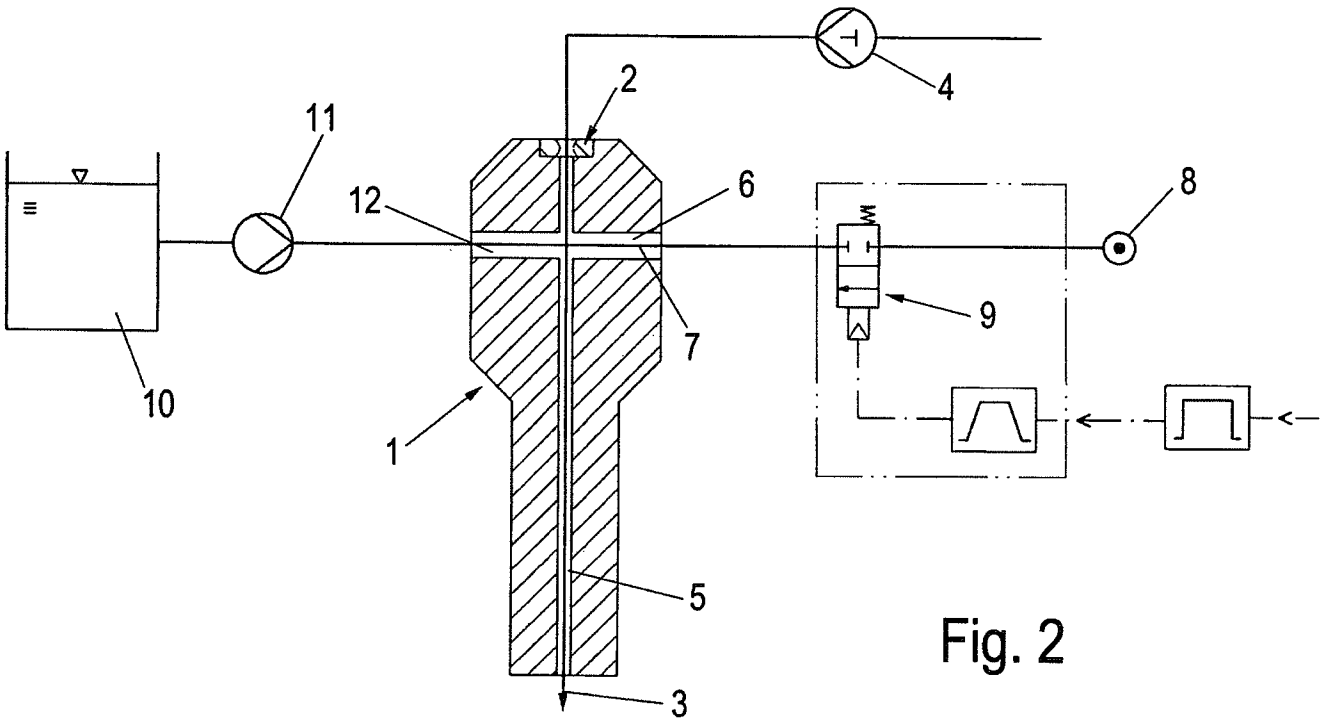
Figure 3:
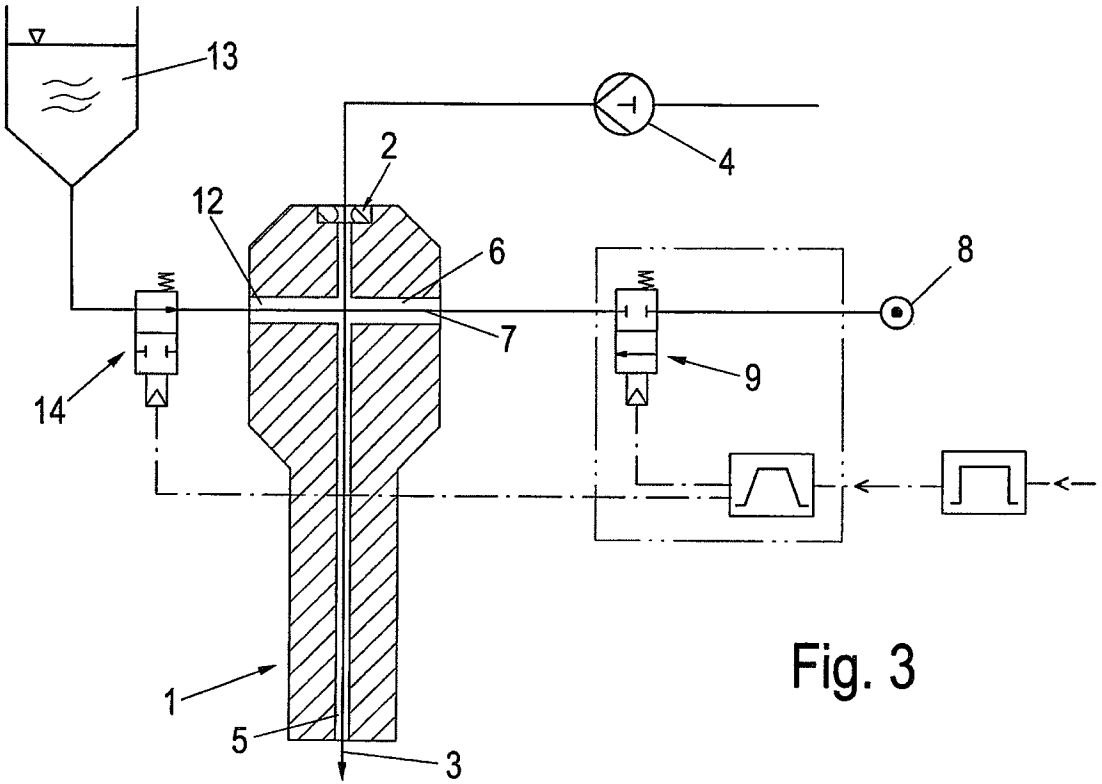

FIG. 1-3 each show a device for performing a method to interrupt the operation of a cutting jet 5 exiting a cutting head 1 having a nozzle 2, wherein according to the invention, the cutting jet 5 is supplied as needed, i.e., regularly or irregularly, with lateral interfering means 7 following the exit of the nozzle 2 that reduces the speed and energy density of the cutting jet 5.

The cutting head 1 has an exit channel 5 extending in the direction of flow of the cutting jet 3 and directly following the nozzle exit.

To supply the interfering means 7, an interfering means supply 6 ends in the side of the exit channel 6 closer to the nozzle than the exit of the cutting jet 3, and an interfering jet consisting of a liquid or a gas in the exemplary embodiments is guided through it, the interfering jet being supplied by an interfering means source 8 such as a pump. As a liquid jet, the pressure of the interfering jet can be below 1-3 bar.

The fluid forming the cutting jet 3 is supplied under high pressure by a high-pressure pump 4 to the nozzle 2 where the pressure energy is converted into kinetic energy so that the cutting jet 3 can exit the cutting head 1, i.e., the exit channel 5, at a high speed while operating.

To interrupt the operation of the cutting jet 3 by reducing the exit speed and energy density of the cutting jet 3 enough for there not to be any energy to remove the material to be cut, the interfering means 7, the interfering jet in the examples, is turned on and off by an actuating organ in the form of a valve 9 which interrupts or opens the supply of the interfering means 8.

The valve 9 can be switched by means of a computer to interrupt the operation of the cutting jet 3 in predetermined intervals.

In the example shown in FIG. 1, only water is used as the cutting medium, whereas in the variants shown in FIG. 2, an abrasive is supplied to the cutting jet 3 in the form of a suspension deposited in a suspension container 10 and supplied to the cutting jet 3 by means of a pump 11 via a feed line 12 in cutting head 1, that also empties in the exit channel 5.

In the examples, the discharge openings of the interfering mains supply 6 and feed line 12 oppose each other.

In the device according to FIG. 3, the cutting jet 3 is also supplied with an abrasive that consists of sand in this case which is stored in a sand container 13.

The supply of abrasive is dependent on the supply of the interfering means 7 for which a valve 14 in the abrasive supply is provided which opens when the supply of interfering means 7 is interrupted to supply the abrasive to the cutting jet 3, whereas when the valve 9 is opened and the interfering means 7 is consequently supplied, valve 14 closes to interrupt the supply of abrasive. The control of the two valves 9, 14 is preferably mutually linked.

LIST OF REFERENCE CHARACTERS

1 Cutting head
2 Nozzle
3 Cutting jet
4 High pressure pump
5 Exit channel
6 Interfering means supply
7 Interfering means jet
8 Interfering means source
9 Valve
10 Suspension container
11 Pump
12 Feed line
13 Sand container
14 Valve

The invention claimed is:

1. A method for interrupting cutting action of a cutting jet exiting a cutting head having a nozzle, wherein the cutting jet is intermittently provided with a supply of an interfering fluid, the supply being provided as needed from a side of the cutting head in a direction transverse to a direction of flow of the cutting jet, the supply of fluid being provided at a point following the cutting jet's exit from the nozzle, the supply of fluid thereby reducing an energy density of the cutting jet sufficiently to interrupt cutting action by the cutting jet.

2. The method according to claim 1, wherein the supply of the interfering fluid is controlled by a computer.

3. The method according to claim 2, wherein the supply of interfering fluid is interrupted by a valve.

4. The method according to claim 1, wherein the interfering fluid is a liquid medium.

5. The method according to claim 1, wherein the interfering fluid is a gaseous medium.

6. The method according to claim 1, wherein the cutting jet is supplied an abrasive, and wherein the supply of abrasive is dependent on the supply of interfering fluid.

7. A device to implement the method according to claim 1, the device comprising a cutting head having a nozzle opening to an exit channel is in a direction of flow of the cutting jet, the cutting head defining at least one supply channel in the side of the cutting head and in fluid communication with the exit channel, the device further comprising a computer-controlled actuating organ for selectively supplying interfering fluid to the exit channel via the supply channel.

8. The device according to claim 7, wherein the supply of interfering fluid can be turned on and off by a first valve arranged between and interfering the supply channel and an interfering fluid source.

9. The device according to claim 8, wherein that the first valve is arranged in the cutting head.

10. The device according to claim 8, further comprising a feed line channel through which an abrasive can be supplied to the cutting jet, the cutting head defining the feed line channel, the supply channel being arranged opposite to or offset from the feed line channel in the cutting head.

11. The device according to claim 10, wherein a flow of abrasive being delivered via the feed line channel can be turned on and off by a second valve, the first and second valves being alternately switchable.

* * * * *